US005809602A

United States Patent [19]

Kitchens

[11] Patent Number: 5,809,602

[45] Date of Patent: Sep. 22, 1998

[54] WINDOW SCRAPER

[76] Inventor: Richard A. Kitchens, 1617 S. Hwy. 85, Fayetteville, Ga. 30214

[21] Appl. No.: 738,188

[22] Filed: Oct. 28, 1996

[51] Int. Cl.[6] ..... B27C 1/10

[52] U.S. Cl. ..... 15/93.1; 15/236.01; 30/172; 30/500

[58] Field of Search ..... 15/93.1, 236.1; 30/172, 347, 500, 475

[56] References Cited

U.S. PATENT DOCUMENTS

| | | | |
|---|---|---|---|
| 1,281,207 | 10/1918 | Richens | 30/475 |
| 1,636,863 | 7/1927 | Jehle | 30/475 |
| 1,727,383 | 9/1929 | Simonides | 30/475 |
| 2,894,549 | 7/1959 | Garland | 30/475 |
| 3,380,094 | 4/1968 | Comstock | 15/236.1 X |
| 3,731,338 | 5/1973 | Walsh et al. | 15/236.1 |
| 4,360,048 | 11/1982 | Schadlich et al. | 30/475 |
| 4,584,772 | 4/1986 | Bergler | 30/475 |
| 5,024,000 | 6/1991 | Casal | 30/475 |

FOREIGN PATENT DOCUMENTS

| | | | |
|---|---|---|---|
| 6062983 | 8/1994 | Japan | 15/93.1 |

*Primary Examiner*—Jeanette E. Chapman
*Attorney, Agent, or Firm*—James B. Middleton

[57] ABSTRACT

A window scraper has a drum that mounts four blades on its periphery, the blades extending generally tangentially so the sharp edges project beyond the drum. A shroud covers the drum and blades, and the shroud defines an opening where the blades project through the opening to engage a glass pane to be scraped. Switch actuators are placed beside the opening so the opening must be urged against a surface before the drum can be rotated. The motor and battery may be placed within the handle of the scraper. A safety shield is pivoted to the shroud, and can be used to cover the opening in the shroud when the scraper is not is use.

7 Claims, 1 Drawing Sheet

WINDOW SCRAPER

BACKGROUND OF THE INVENTION

1. Field of the Invention

This invention relates generally to scraping apparatus, and is more particularly concerned with a powered window scraper for removing paint and the like.

2. Discussion of the Prior Art

When window frames are painted, one frequently gets paint on the glass panes as well as the frame, mullions etc. that are supposed to be painted. The paint is normally removed after the paint has dried by scraping with a razor blade or the like. The sharp edge of the razor blade relatively easily cuts the paint from the glass pane; and, the blade is held on an acute angle with respect to the pane so the sharp edge does not attempt to cut into the pane and cause scratches. This scraping of glass panes is done by hand, and is somewhat tedious and time consuming.

The prior art has provided a number of scraping devices for scraping various surfaces. Some of the prior art scrapers comprise plates that rotate in a plane parallel to the surface being scraped, such as in U.S. Pat. No. 3,613,147 to Norfleet. The Norfleet device has an action similar to a wood plane (specifically, a block plane), and would require very accurate adjustments to scrape glass. Additionally, the circular pattern scraped does not fit well with rectangular panes.

Another form of prior art scraper is in the nature of a flail. One such device is shown in U. S. Pat. No. 3,958,294 to Thompson. Wires or tines are urged against a surface by centrifugal force as the device is rotated in a plane perpendicular to the surface being scraped. Such a violent actions would of course be very damaging to glass. At the least, the glass would be badly scratched, and at the worst the glass may be broken.

Thus, the prior art has not provided a powered window pane scraping device that is easy to use and safe for window panes.

SUMMARY OF THE INVENTION

The present invention provides a drum type scraping member having blades fixed to the periphery of the member. The drum type member is then rotated about its axis so the blades successively engage the surface to be scraped. The blades are flexible so the blade will scrape some length of a path each time a blade engages the surface. A shroud covers the drum type member so the blades are completely enclosed during use, and a handle is fixed to the shroud to facilitate manipulation of the apparatus. The drive motor and battery may be contained in the handle for convenience. Preferably there will be a safety switch means requiring that the shroud be placed firmly against a surface before the motor can be energized. In addition, it is contemplated that a safety shield will cover the blades when not in use.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
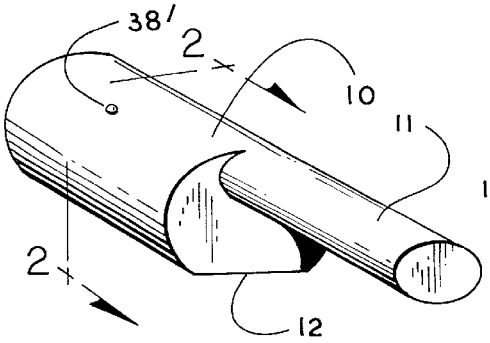
FIG. 1 is a perspective view showing a scraper made in accordance with the present invention.

Referring now more particularly to the drawings, and to that embodiment of the invention here presented by way of illustration, FIG. 1 shows a scraping device comprising a shroud 10 having a handle 11 extending therefrom. It will be noticed that the shroud 10 is generally cylindrical, but has its bottom cut along a secant at 12. The straight portion 12 is held against the surface to be scraped.

Figure 2:
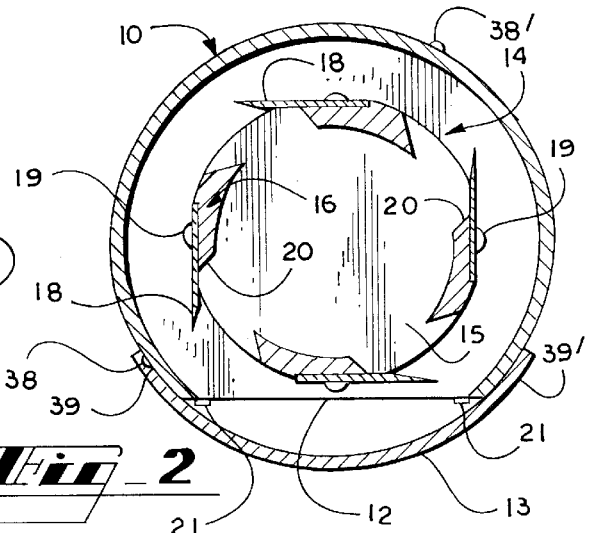
FIG. 2 is an enlarged, cross-sectional view taken along the line 2—2 in FIG. 1.

Looking at FIG. 2 of the drawings, the drum type member 14 is shown within the shroud 10, and a safety shield 13 covers the opening 12. The member drum type 14 includes circular end plates 15 and somewhat wedge shaped linear bars 16 extending between the end plates 15. As here shown, each of the bars 16 carries a blade 18 which is fixed to the bar 16 by rivets, screws or the like 19. The blades 18 are disposed approximately tangentially to the member 14, with the sharp edges of the blades lying beyond the radius of the member 14. It will be noticed that the blades 18 extend well beyond the bars 16 so that the blades 18 have a free end that can flex when the sharp edge engages the surface to be scraped.

Those skilled in the art will understand that the bars 16 may be shaped as desired; however, as here shown the bars 16 have a tapered leading edge 20 to prevent the build-up of material. The tapered edge 20 will cause the chips of paint or the like to pass into the center of the member 14. All of the bars 16 are the same, so all carry the same reference numerals.

With the above description in mind, it will be understood that the shroud 10 will be urged against a surface to be scraped. This will depress the switch actuators 21 and energize the device so the member 14 will rotate in a counterclockwise direction as viewed in FIG. 2. The blades 18 extend from the member 14 sufficiently that, at the straight portion, or opening, 12, the blades will engage the surface to be scraped. While four blades 18 are here shown, those skilled in the art will understand that only one blade may be used, or any other number of blades as desired.

Figure 3:
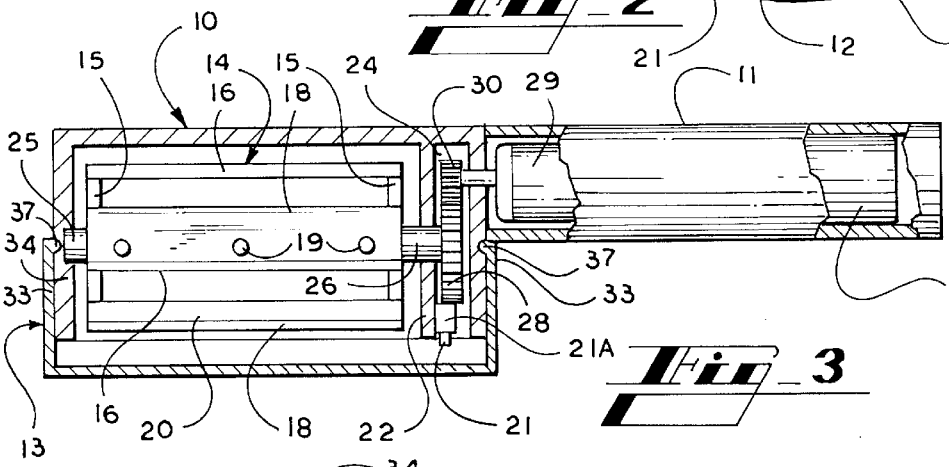
FIG. 3 is a side elevational view, partially in cross-section, of the device shown in FIG. 1.

Looking at FIG. 3 of the drawings along with FIG. 2, the shroud 10 includes an interior wall 22 for defining a gear box 24. The drum type member 14 is mounted on stub shafts 25 and 26, the shaft 26 extending into the gear box 24 and carrying a gear 28. The handle 11 contains an electric motor 29 which carries a gear 30 on its shaft, the gear 30 meshing with the gear 28. As a result, when the motor 29 is energized, the drum type member 14 will be rotated.

Figure 5:
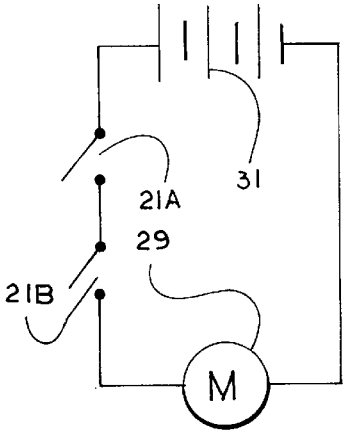

As here shown, the handle 11 further contains a battery 31 for providing electric power to the motor 29. As is shown schematically in FIG. 5, the battery 31 is connected through two switches 21A and 21B to the motor 29. The switches 21A and 21B are in series, so both switches must be closed for the motor 29 to be energized. It will be understood that the actuators 21 operate the switches 21A and 21B.

In FIG. 3 it can be seen that the safety shield 13 has end segments 33 that are pivotably carried by the end walls of the shroud 10. Tips 37 enter complementary depressions in the walls of the shroud as shown. Similarly, there are tips 38 and 38' that engage holes 39 and 39' in the safety shield to hold the shield in place.

Figure 4:
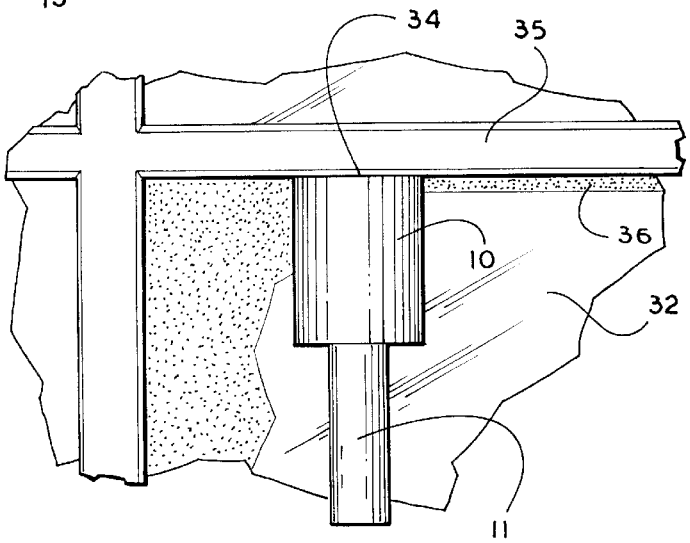
FIG. 4 is an elevational view showing the device of FIG. 1 in use scraping a window pane; and, FIG. 5 is a schematic circuit diagram for the device of FIGS. 1–4.

Use of the scraper of the present invention is illustrated in FIG. 4 of the drawings. One can grasp the handle 11 of the device, and the shroud 10 will extend down to engage the window 32. With the opening 12 against the window 32, the switch actuators 21 will be depressed, causing the motor 29 to rotate the member 14. The end 34 of the shroud 10 is preferably urged against the mullion 35, or the frame of the window, and moved along the window pane 32. Since the blades 18 do not extend all the way to the end 34, there will be a thin stripe of paint 36 remaining on the pane 32; however, the stripe 36 will be uniform and will appear as part of the mullion 35.

It will therefore be seen that the present invention provides an electrically powered window pane scraper that is quick and efficient in removing paint and the like from window panes. While the above description concerns paint removal adjacent to mullions or frames, it will be recognized that any area of a window can be scraped. Also, paper labels and the like may be removed as well as paint, varnish and such.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A window scraper comprising a drum type member having an axis, said drum type member being rotatable about said axis, and at least one blade carried by said drum type member generally at the periphery of said member, a shroud covering said drum type member, said shroud defining an opening for allowing said at least one blade to project through said opening as said member rotates, and handle means for holding said window scraper, wherein said at least one blade has a sharp edge, and said blade extends approximately tangentially of said drum type member to dispose said sharp edge at a greater radius than he periphery of said drum type member.

2. A window scraper as claimed in claim 1, wherein said drum type member comprises a pair of end plates, and a plurality of bars extending between said pair of end plates, said at least one blade comprises a plurality of blades, and each blade of said plurality of blades is fixed to one bar of said plurality of bars.

3. A window scraper as claimed in claim 2, and further including a pair of stub shafts fixed to said pair of end plates for rotatably mounting said drum type member, and drive means on one of said stub shafts.

4. A window scraper as claimed in claim 3, and including a motor within said handle means, and second drive means on said motor for driving said drive means on one of said stub shafts.

5. A window scraper as claimed in claims 4, and further including a battery within said handle for providing electric power to said motor.

6. A window scraper comprising a drum type member having an axis, said drum type member being rotatable about said axis, and at least one blade carried by said drum type member generally at the periphery of said member, a shroud covering said drum type member, said shroud defining an opening for allowing said at least one blade to project through said opening as said member rotates, and handle means for holding said window scraper, and including a motor within said handle means for rotating said drum type member, a battery within said handle for providing electric power to said motor, circuit means for connecting said battery to said motor, switch means connected in said circuit means for selectively causing energization of said motor, and switch operating means, said switch operating means being disposed adjacent to said opening in said shroud.

7. A window scraper comprising a drum type member having an axis, said drum type member being rotatable about said axis, and at least one blade carried by said drum type member generally at the periphery of said member, a shroud covering said drum type member, said shroud defining an opening for allowing said at least one blade to project through said opening as said member rotates, and handle means for holding said window scraper, and further including a safety shield comprising segments pivoted to said shroud, and a shield rotatable around said shroud and disposable selectively over said opening and adjacent to said opening.

* * * * *